US007967021B2

(12) United States Patent
Montgomery et al.

(10) Patent No.: US 7,967,021 B2
(45) Date of Patent: Jun. 28, 2011

(54) MULTIPURPOSE STRETCHING/EXERCISE CANE

(76) Inventors: Robert Duane Montgomery, Reno, NV (US); Margaret Ann Montgomery, Reno, NV (US)

( * ) Notice: Subject to any disclaimer, the term of this patent is extended or adjusted under 35 U.S.C. 154(b) by 0 days.

(21) Appl. No.: 12/583,275

(22) Filed: Aug. 18, 2009

(65) Prior Publication Data

US 2011/0041885 A1 Feb. 24, 2011

(51) Int. Cl.
*A45B 3/00* (2006.01)

(52) U.S. Cl. ..... 135/66

(58) Field of Classification Search ..... 135/65, 135/66, 68, 72; 482/44–46
See application file for complete search history.

(56) References Cited

U.S. PATENT DOCUMENTS

| | | | | |
|---|---|---|---|---|
| 5,300,002 | A * | 4/1994 | Freye | 482/114 |
| 5,577,827 | A * | 11/1996 | Leffingwell et al. | 362/109 |
| 5,788,608 | A * | 8/1998 | Wilkinson | 482/51 |
| 5,976,059 | A * | 11/1999 | Brown | 482/44 |
| 6,055,997 | A * | 5/2000 | Greenstadt et al. | 135/65 |
| 6,715,794 | B2 * | 4/2004 | Frank | 280/826 |
| 7,087,002 | B2 * | 8/2006 | Montgomery | 482/121 |
| 7,094,182 | B1 * | 8/2006 | Holten | 482/46 |
| 7,094,186 | B2 * | 8/2006 | Diakonov et al. | 482/104 |
| 7,175,575 | B1 * | 2/2007 | Dantolen | 482/128 |

* cited by examiner

*Primary Examiner* — David Dunn
*Assistant Examiner* — Noah Chandler Hawk

(57) ABSTRACT

A multipurpose exercise cane having a top end that is similar in construction to that of a typical crutch and the bottom end includes a detachable foot. However, it further incorporates an improved hand grip on the top end for ease of use while walking. More importantly, the exercise cane also includes optional features of choice. Such as additional hand grips distanced apart and/or a centralized resistive twisting assembly, a water bottle, a microchip, an outwardly extending feeler, etc. Furthermore, the novel cane is of a unique shape that is substantially flat as opposed to most standard canes that are round or circular in shape.

6 Claims, 3 Drawing Sheets

MULTIPURPOSE STRETCHING/EXERCISE CANE

FIELD OF THE INVENTION

The present invention relates in general to a new and novel exercise cane but more particularly pertains to a cane that is intended to encourage and simplify exercising while walking and/or standing. In one embodiment the top end of the cane is similar in construction to that of a typical crutch and the bottom end includes a detachable foot. However, it further incorporates an improved hand grip on the top end for ease of use while walking. More importantly, the exercise cane also includes optional features of choice. Such as additional hand grips distanced apart and/or a centralized resistive twisting assembly, etc. for convenient stretching exercises. Furthermore, the novel cane is of a unique shape that is substantially flat as opposed to most standard canes that are round/circular in shape.

BACKGROUND OF THE INVENTION

Walking sticks, staffs and/or canes have been well known throughout history and are especially useful as an aid for mobility. The standard store bought cane is of simple construction having some type of hand grip attached onto an elongated circular shaft member and some type of foot member for secure ground engagement. The standard type of cane has proven to be most helpful and is also often recommended by medical professionals for the disabled, elderly, handicapped or the like. However, the standard cane has only been recognized as an implement used while walking or simply trying to move from one location to another. Heretofore the additional physical therapy attributes have not been recognized, suggested and/or implied. Recent studies have been conducted and have now proven that walking in itself is great exercise. However, when walking is combined with additional activity (such as stretching or exercising) this greatly improves general overall health and well being. For example, walking increases blood flow, works the heart, lungs and legs, etc. Stretching provides additional benefits such as it keeps the muscles supple, prepares one for additional movement, increases stamina, aids in weight loss, improves strength, increases mobility, etc. More importantly it has been proven that while walking, stretching and exercising mental well being is also an attribute resultant thereof. People who are physically active are much happier in general and lead much fuller lives. They have more stamina, are more likely to resist and/or recover from an illness, they have more self-confidence, are less depressed, are physically active far later in life, etc. Still further, research has proven that those who are mentally challenged and/or have metal disorders, ailments or diseases such as Alzheimer's and Parkinson's greatly improve with regulated physical therapy.

As a result it is apparent that there is a great need for improvement pertaining to the standard cane and/or exercise bar. Thus, a multipurpose cane that is functional for not only walking but further encourages muscle stretching and exercising would be extremely advantageous and heretofore has yet been attainable and/or available.

OBJECTS AND ADVANTAGES OF THE PRESENT INVENTION

It is therefore a primary object of the present invention to provide and new concept pertaining to use of the typical walking cane. Namely, to provide a walking cane having multiple uses including walking, muscle stretching, exercising and improving overall general health of the user.

It is another object of the present invention to provide a multipurpose exercise cane that is novel in shape, including the top end of which is substantially in the shape of crutch handle as opposed to any standard cane handle. This is an important feature as this greatly enhances the ergonomic physics especially while walking.

Another object of the present invention is to provide a multipurpose exercise cane that is made from any suitable cost effective material of choice. Such as but not limited to aluminum, wood, plastic, etc, dependent upon engineering choice. It is to be noted weight of the cane is important as it must be strong enough to support a user while walking yet lightweight for ease of use. Also, the weight is an important factor when considering the therapeutic attributes while exercising so as to achieve the desired end results.

Still another object of the present invention is to provide a multipurpose exercise cane wherein the above noted material of choice is substantially flat stock material. Whereby, the exercise cane is substantially non-circular in shape. This is an important feature as most canes are round and made from round material so as to form a pole-like structure.

Yet a further object of the present invention is to provide a multipurpose exercise cane that includes optional features of choice. Such as multiple hand grips that assist the user while exercising so as to provide an overall muscle/stretching workout in an effective personalized exercise routine. The multiple hand grips are rotationally mounted so as to allow for twisting of the arms, elbows, wrists, hands and fingers. Other optional features include an outwardly extending feeler that encourages a user to step up and over the feeler while walking.

Another object of the present invention is to provide a multipurpose exercise cane wherein the above noted rotational hand grips may further be mounted in alignment with a tension adjustment mechanism. Whereby, resulting in adjustable rotational tensioned resistance to further enhance the personal physical workout. Thus, users having variable muscle strength/weakness can adjust the hand grips for personalized needs accordingly. This further allows physicians and/or physical therapists to prescribe personalized workouts to strengthen particular muscles for every individual.

A further object of the present invention is to provide a multipurpose exercise cane that may include the centralized section having a resilient resistive twisting assembly. This is also most advantageous for the same reasons pertaining to individualized needs for variable muscle/stretching workouts.

The most important object of the present invention is to provide a multipurpose exercise cane that is versatile and may be used by anyone who simply wishes to improve their health and/or anyone in need of specific physical therapy requirements. The exercise cane is unique and novel as it can be utilized throughout the entire rehabilitative process/program for either a controlled simplified gentle workout or an extremely intense workout.

Still a further object of the present invention is to provide a multipurpose exercise cane that is also most advantageous for mental rehabilitation as well. It has been found that engaging in physical activity (especially gentle stretching or the like) is extremely helpful mentally and emotionally as the physical stimulation also stimulates the brain and helps overall health. Furthermore, the present invention may be used at home, while at work in the office, outdoors, and more importantly during exercise class for group therapy sessions as well.

Another object of the invention is to provide a multipurpose exercise cane that can be used as a simple cane or for exercise purposes. It is to be noted the cane can be manufactured with or without additional optional features depending on the needs of the individual user. The end user may purchase a standard prefab model off the shelf or may order a specialty cane made especially for them, including any optional features and/or aesthetic qualities according to their liking. Furthermore, the present exercise cane may include additional features as provided and taught within my issued U.S. Pat. No. 7,087,002. Namely, a battery operated light, a storage compartment, a drinking bottle with a container therefore, and a novel drinking straw that allows a user to take a drink without interrupting the physical workout.

Also another object of the present invention is to provide a multipurpose exercise cane that when sold includes an instruction/safety manual so as to inform the user of different types of exercising alternatives, including specific stretches for individual muscles, or muscle groups and/or safety precautions, etc.

It is another object of the present invention to provide a multipurpose exercise cane that can also incorporate additional weight to enable the user to broaden and enhance the exercise factor if desired or if prescribed for the user by a professional advisor.

It is another object of the present invention to provide a multipurpose exercise cane that can also be manufactured to include some form of reference to various entities, such as decals; silk screening; solar projected signs of, for example, birds for bird watchers; fish for fishermen, or the like. The exercise cane can also include some form of camera and/or scope to provide the user additional functions.

Still a further object of the present invention is to provide another optional feature such as the cane may include an embedded microchip that is easily located and tracked via GPS. Whereby, the owner of the cane can be located at all times if needed. This method of having the embedded microchip can also, when the cane is scanned, provide information regarding the date and place of manufacture of the cane and may show serial and registration information pertaining to that one particular cane.

Other objects and advantages will become apparent when taken into consideration with the following specification and drawings.

DETAILED DESCRIPTION OF THE DRAWINGS

Figure 1:
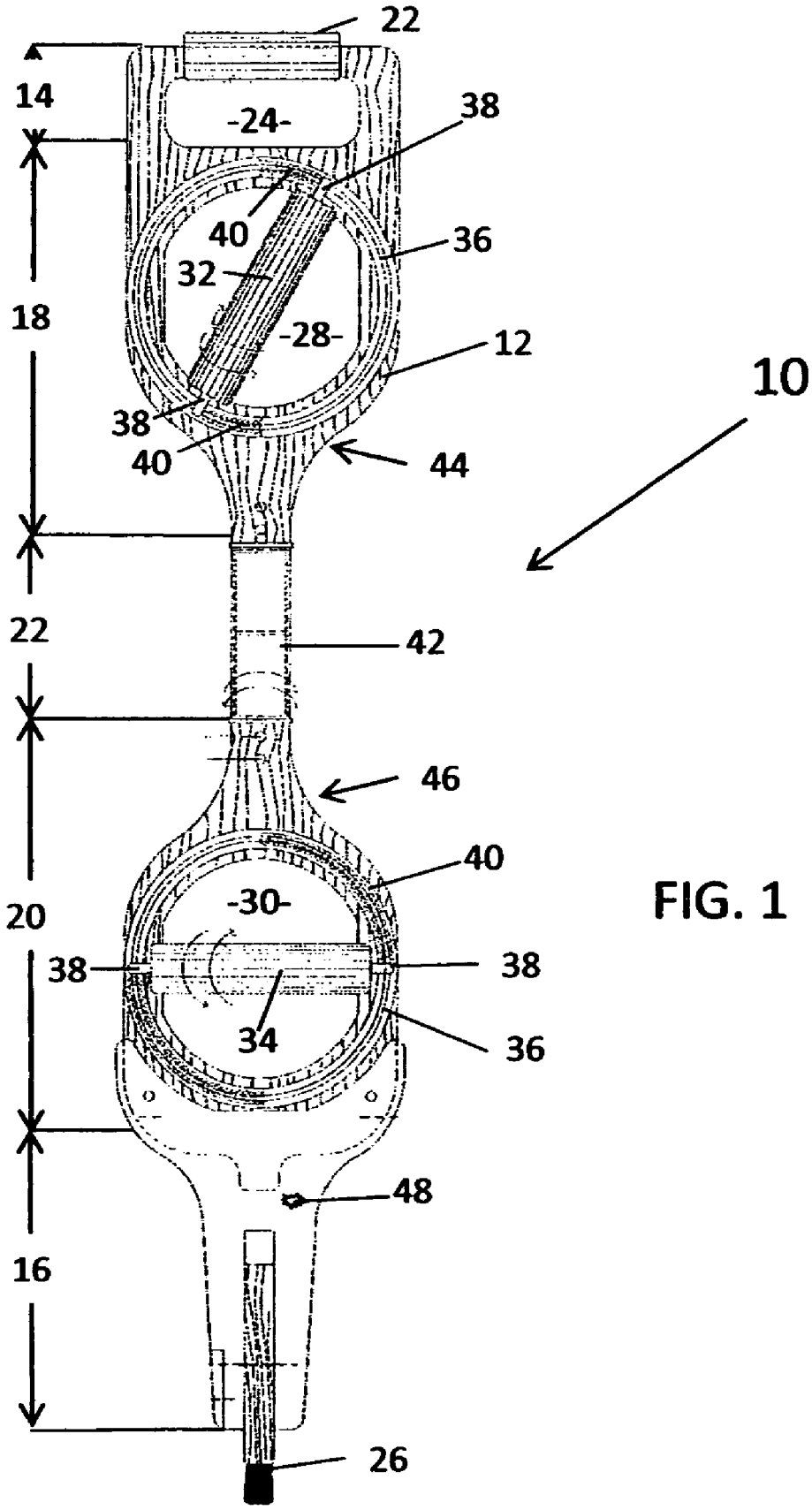
FIG. 1 is substantially a front side overview depicting a first embodiment for the present invention.
Figure 2:
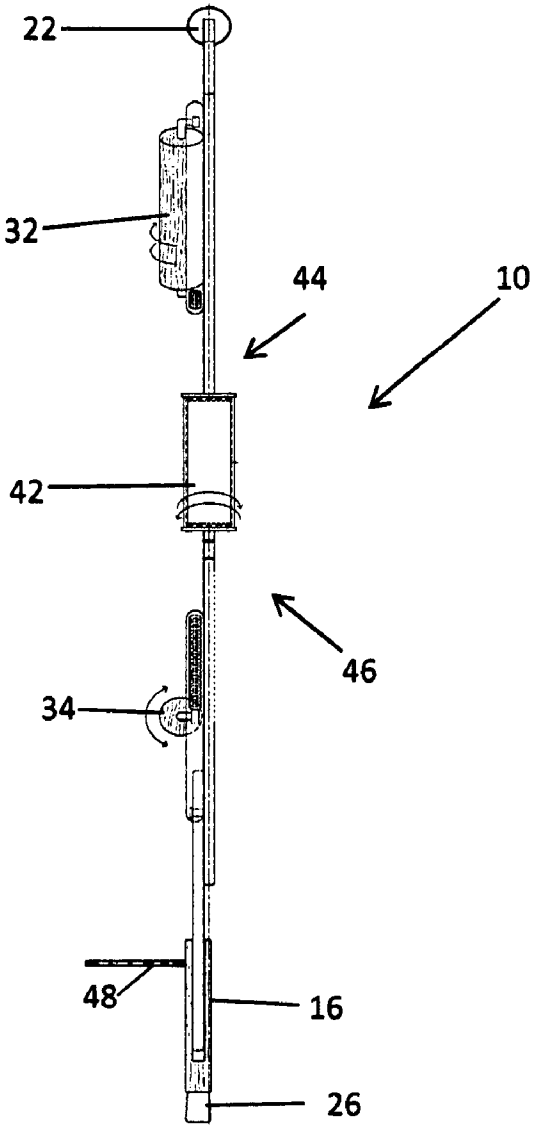
FIG. 2 is substantially a side view of FIG. 1.

Referring now in detail to the drawings wherein like characters refer to like elements throughout the various drawings. As illustrated in FIGS. 1 and 2, (10) represents an overview for the preferred embodiment for my new multipurpose exercise cane. It is to be understood numerous variations are possible so this embodiment is only depictive of one configuration and/or embodiment.

The multipurpose exercise cane (10) comprising in combination substantially of an elongated main shank member (12) having a top end (14), a bottom end (16), a top section (18), a bottom section (20) and a central section (22). As depicted the top end (14) is substantially in the shape of a crutch handle having a horizontal hand grip (22) positioned above a horizontal open cut-out area (24) and the bottom end (16) having a detachable foot (26).

It is to be noted the novel concept of the top end (14) being in the shape of a crutch is very important and most beneficial. A standard cane is typically formed with just a knob or circular type of hand grip. As a result, all of the weight is distributed onto the knob and/or hand grip. This causes additional stress on the wrists, hands, arms and shoulders. Furthermore, the standard hand grip causes unnatural difficulty while walking. For example, the standard hand grip makes the user distribute all of their weight onto the cane only while the cane is in complete vertical alignment in an up position. Thus, while walking "during the forward step motion" the cane is not really aiding the user until the step is completed. The shape of the crutch hand of the present invention eases the user's wrists, hands, arms and shoulders as the crutch style handle rolls with the user throughout the entire stepping motion and this greatly improves overall ergonomic performance of the cane.

The top section (18) further includes a first opening (28) and the bottom section (20) includes a second opening (30). The first opening (28) includes a first exercise hand grip (32) therein and the second opening (30) includes a second exercise hand grip 34) therein. In the preferred embodiment as depicted in FIG. 1, first exercise hand grip (32) is rotationally mounted within said first opening (28) and said second exercise hand grip (34) is rotationally mounted within said second opening (30). This rotational mounting is accomplished by each hand grip (30 & 32) having protruding end pins (38) of which are slid ably engaged within an internal circular shaped passageway (36). Whereby, each of the hand grips (32 & 30) can be rotated along two "variable directional" opposing axis. Namely, "when properly used" the user holds the cane horizontally outwardly away from the body with the arms extended and each hand grip (32 & 30) is held in the vertical position with the hands. Thereafter, the user can twist/rotate each hand grip in a circular spindle type motion causing the hand grip to rotate along the vertical axis while simultaneously the wrist and hand pivot along the horizontal axis, respectively. The second variable direction opposing axis is incurred when the user rotates the hand grip in a clockwise/counter-clockwise direction causing the hand grip to rotate along the horizontal axis while simultaneously the wrist and hand to pivot along the vertical axis, respectively. These variable motions are novel as typical hand grips do not have these rotational advantages. This is very important for therapeutic value and more importantly ergonomic qualities. It is to be understood that studies have proven that hand grips that are not ergonomic in design and structure are damaging and cause Carpal tunnel syndrome among other muscle related injuries and due to the novel hand grips of the present invention such related repetitive motion injuries are less likely. Furthermore, due to these variable directional hand grips a physical therapist can determine and inform a patient as to proper movement and instruct accordingly for strengthening exercises that are safe and most advantageous for each individual. To provide additional personalized therapy and proper treatment the present hand grips may further include "as an option" a tension/resistive element so as to increase muscle strength if required and can be regulated by the therapist. For example, each internal circular shaped passageway (36) may further contain a spring mechanism (40) removably affixed therein and each of the protruding end pins (38) "upon contact with the spring mechanism (40)" compress against the spring and thus resistive pressure requires the user to apply more force resulting in increased muscle strength. It is to be understood the spring mechanism can be easily interchanged to allow for adjusting of the resistive force. Whereby, throughout the entire therapeutic rehabilitative program the therapist can vary the workout routine according to individualized requirements.

Yet a further novel optional feature for the multipurpose exercise cane (10) of the present invention is to include within the central section a resilient resistive twisting assembly (42). This is extremely important again for improving the overall exercise therapy program. The twisting assembly (42) is most advantageous for not only improving the user's strength but more importantly provides a complete safe workout for the entire upper body muscles, including the hands, wrists, arms, shoulders, neck, back and even the buttocks. It is to be understood the resilient resistive twisting assembly (42) can be incorporated in numerous ways. Thus, the following description is only illustrative of one possible configuration of engineering choice. Namely, the resistive twisting assembly (42) includes the main shank member (12) being cut in two forming a first half section (44) and a second half section (46). Each have section (44 & 46) are interconnected onto the resistive twisting assembly (42) by any suitable attachment means of engineering choice. Such as brackets, screws, bolts, glue, etc, (not shown for clarity purposes). The actual resistive twisting assembly (42) can be made of any suitable material of choice such as Neoprene or the like. Furthermore, the resistive twisting assembly (42) may further be slid ably encased within an outer shell for aesthetic purposed if desired.

Still another optional feature for the present multipurpose exercise cane (10) is to include "at a location of choice" upon the bottom end (16) an outwardly extending feeler (48). This is again a very important advantage as while walking the user is encouraged to "step up and over" the feeler (48) resulting in an improved advanced leg workout. The feeler (48) can be made from any material of engineering choice, such as a spring, rubber, flexible plastic, etc. and removably attached by any suitable fastening means such as a friction fit or the like. Also, it is to be noted the user can attach the feeler onto either side of the cane so as to comply with the needs of right/left side use of the cane.

Yet another optional feature of the multipurpose exercise cane (10) (depending on the end user's preferences) is to provide a detachable foot (26) that may be completely removed if desired. This is most advantageous if the user wishes to use the multipurpose exercise cane (10) strictly for exercising purposes and need for a walking aid is not necessary. Furthermore, the multipurpose exercise cane (10) can be easily used for exercising by handicapped individuals who may be restricted to a wheelchair or even those who are bedridden.

Figure 3:
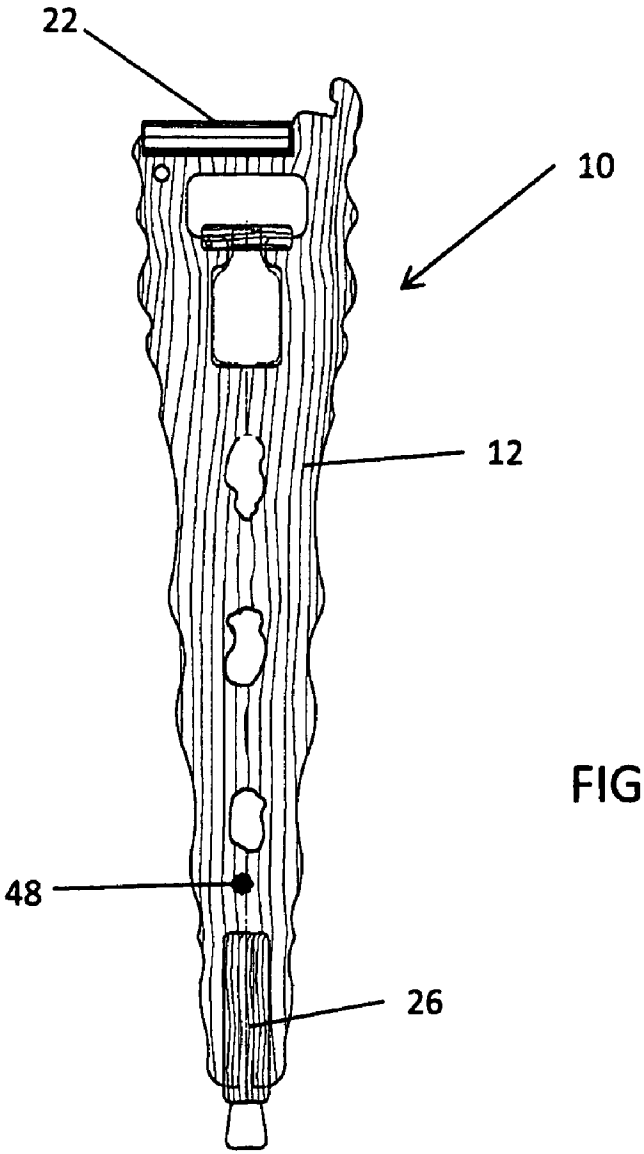
FIG. 3 is substantially a front side overview depicting a second embodiment for the present invention.

It is to be noted that the multipurpose exercise cane (10) can be manufactured having numerous configurations and/or options of user choice and is not limited to any particular shape and/or features. The multipurpose exercise cane (10) can be produced and manufactured as an off the shelf item or it can be ordered by an individual and made specifically according to their personal needs. For example, FIG. 3 depicts another embodiment wherein the multipurpose exercise cane (10) is a simplified version of which is not only aesthetically pleasing but further provides a water bottle supported therein which is a novelty.

It can now be seen the present invention is new and innovative and provides a multipurpose exercise cane having unique qualities heretofore not taught within the known prior art.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

What we claim as new and wish to secure by Letters Patent is:

1. A multipurpose exercise cane comprising in combination: an elongated main shank member having a top end; a bottom end; a top section; a bottom section; and a central section; said multipurpose exercise cane is made from flat stock material, thus said multipurpose exercise cane is non-circular in shape, said top end being in the shape of a crutch handle having a horizontal hand grip positioned above a horizontal open cut-out area, said bottom end having a detachable foot, said top section includes a first opening, said bottom section includes a second opening, said first opening having a first exercise hand grip therein, said second opening having a second exercise hand grip therein, said first exercise hand grip is rotationally mounted within said first opening, said second exercise hand grip is rotationally mounted within said second opening, each said hand grip having protruding end pins which are slidably engaged within an internal circular shaped passageway, each said hand grip can be rotated along two variable directional opposing axis, whereby;

when a user holds said multipurpose exercise cane horizontally each said hand grip can rotate along the vertical axis and clock wise counter-clockwise along the horizontal axis.

2. The multipurpose exercise cane of claim 1 wherein said central section further includes a resilient resistive twisting assembly.

3. The multipurpose exercise cane of claim 1 wherein said bottom end further includes an outwardly extending feeler.

4. The multipurpose exercise cane of claim 1 wherein said elongated main shank member is non-circular in shape.

5. The multipurpose exercise cane of claim 1 wherein each said hand grip is mounted in alignment with a tension adjustment mechanism.

6. The multipurpose exercise cane of claim 5 wherein said tension adjustment mechanism comprising: said internal circular shaped passageway further contains a spring mechanism removably affixed therein and said protruding end pins upon contact with said spring mechanism compress against said spring mechanism resulting in adjustable rotational tensioned resistance.

* * * * *